US007443089B2

(12) United States Patent
Hoffman et al.

(10) Patent No.: US 7,443,089 B2
(45) Date of Patent: Oct. 28, 2008

(54) SPARK PLUG WITH TAPERED FIRED-IN SUPPRESSOR SEAL

(75) Inventors: John W. Hoffman, Perrysburg, OH (US); James D. Lykowski, Temperance, MI (US)

(73) Assignee: Federal Mogul World Wide, Inc., Southfield, MI (US)

( * ) Notice: Subject to any disclaimer, the term of this patent is extended or adjusted under 35 U.S.C. 154(b) by 320 days.

(21) Appl. No.: 11/454,995

(22) Filed: Jun. 16, 2006

(65) Prior Publication Data

US 2007/0290594 A1 Dec. 20, 2007

(51) Int. Cl.
*H01T 13/20* (2006.01)

(52) U.S. Cl. ..... 313/141

(58) Field of Classification Search ..... 313/136, 313/141, 142

See application file for complete search history.

(56) References Cited

U.S. PATENT DOCUMENTS

| | | | |
|---|---|---|---|
| 2,371,211 | A | 3/1945 | Barrington |
| 3,061,756 | A | 10/1962 | Henderson |
| 3,909,459 | A | 9/1975 | Friese et al. |

(Continued)

FOREIGN PATENT DOCUMENTS

| | | |
|---|---|---|
| DE | 4431143 | 3/1996 |

(Continued)

OTHER PUBLICATIONS

Patent Abstracts of Japan:, 03225785 A (Oct. 4, 1991) O. Takafumi et al., 02281587 A (Nov. 19, 1990) O. Takafumi, 02281586 A (Nov. 19, 1990) O. Takafumi, 05152053 A (Jun. 18, 1993) O. Takafumi et al.

*Primary Examiner*—Vip Patel
(74) *Attorney, Agent, or Firm*—Robert L. Stearns; Dickinson Wright PLLC

(57) ABSTRACT

A spark plug (10) for a spark ignited internal combustion engine includes a suppressor seal pack (54) interposed between an upper terminal stud (46) and a lower center electrode (60). The suppressor seal pack (54) includes a top layer of conductive glass (52) surrounding the bottom end (50) of the terminal stud (46) and a lower glass seal layer (58) surrounding a head (62) of the center electrode (60). A resistor layer (56) fills the space between the conductive glass layers (52, 58). The resistor layer (56) has a larger first cross-sectional area (76) at its upper end and a smaller second cross-sectional area (78) at its lower end. A reducing taper (80) establishes a progressive transition between the greater and lesser cross-sectional areas (76, 78). The reducing taper (80) is located in a large shoulder region (LS) which is defined as the longitudinal dimension between the theoretical reference point (70) at the filleted transition (26) and the theoretical reference point (68) at the upper seat (17). The suppressor seal pack (54) is of the fired-in variety in which each layer (54, 56, 58) is separately filled as a granular material, tamped and then cold pressed using the terminal stud (46). The assembly is then heated in a furnace, then removed so that the terminal stud (46) can be used to hot press the suppressor seal pack (54) into a final, operative condition. The suppressor seal pack (54) has a length (SL) which is maximized by use of a positive "A" dimension (+A) defined as the longitudinal distance between the center electrode head (62) seat and the theoretical location (72) of the lower seat (19).

10 Claims, 4 Drawing Sheets

U.S. PATENT DOCUMENTS

| | | | |
|---|---|---|---|
| 3,967,230 | A | 6/1976 | Kamigaito et al. |
| 4,004,183 | A | 1/1977 | Oki et al. |
| 4,070,740 | A | 1/1978 | Bardet |
| 4,112,330 | A | 9/1978 | Stimson et al. |
| 4,173,731 | A | 11/1979 | Takagi et al. |
| 4,400,643 | A | 8/1983 | Nishio et al. |
| 4,442,375 | A | 4/1984 | Nishio et al. |
| 4,504,411 | A | 3/1985 | Sakai et al. |
| 4,519,784 | A | 5/1985 | Pollner |
| 4,539,503 | A | 9/1985 | Esper et al. |
| 4,713,582 | A | 12/1987 | Yamada |
| 4,795,944 | A | 1/1989 | Stimson |
| 5,095,242 | A | 3/1992 | Richeson |
| 5,210,458 | A | 5/1993 | McDougal |
| 5,304,894 | A | 4/1994 | Stimson |
| 5,952,770 | A | 9/1999 | Mueller et al. |
| 6,160,342 | A | 12/2000 | Nishikawa et al. |
| 6,191,525 | B1 | 2/2001 | Tanaka et al. |
| 6,320,317 | B1 | 11/2001 | Keller et al. |
| 6,334,800 | B1 | 1/2002 | Nishikawa et al. |
| 6,380,664 | B1 | 4/2002 | Pollner |
| 6,509,676 | B1 | 1/2003 | Durling |
| 6,559,578 | B1 | 5/2003 | Herden et al. |
| 6,566,792 | B2 | 5/2003 | Nishikawa |
| 6,580,202 | B1 | 6/2003 | Pollner |
| 6,794,802 | B2 | 9/2004 | Pollner |
| 7,019,448 | B2 | 3/2006 | McMurray et al. |
| 7,059,926 | B2 | 6/2006 | McMurray et al. |
| 7,073,256 | B2 | 7/2006 | Muranaka et al. |
| 2004/0266306 | A1 | 12/2004 | Matsutani et al. |
| 2006/0099872 | A1 | 5/2006 | McMurray et al. |
| 2007/0290593 | A1 * | 12/2007 | Kowalski ..... 313/141 |

FOREIGN PATENT DOCUMENTS

| | | |
|---|---|---|
| DE | 19623989 | 1/1998 |
| DE | 19636537 | 3/1998 |
| DE | 19818214 | 10/1999 |
| EP | 0101547 | 2/1984 |
| EP | 0400950 | 12/1990 |
| EP | 0484168 | 5/1992 |
| EP | 0995245 | 4/2000 |
| GB | 0 899 839 B1 | 1/2004 |
| WO | WO9607226 | 3/1996 |

* cited by examiner

SPARK PLUG WITH TAPERED FIRED-IN SUPPRESSOR SEAL

BACKGROUND OF THE INVENTION

1. Field of the Invention

The subject invention relates to a spark plug for a spark-ignited internal combustion engine, and more particularly toward a spark plug having a fired-in suppressor seal pack between an upper terminal stud and a lower center electrode.

2. Related Art

A spark plug is a device that extends into the combustion chamber of an internal combustion engine and produces a spark to ignite a mixture of air and fuel. In operation, charges of up to about 40,000 volts are applied through the spark plug center electrode, thereby causing a spark to jump the gap between the center electrode and an opposing ground electrode.

Electromagnetic interference (EMI), also known as radio frequency interference (RFI), is generated at the time of the electrical discharge across the spark gap. This is caused by the very short period of high frequency, high current oscillations at the initial breakdown of the gap and at points of re-firings. This EMI or RFI can interfere with entertainment radio, 2-way radio, television, digital data transmissions or any type of electronic communication. In a radio for example, the EMI or RFI is usually noticed as a "popping" noise in the audio that occurs each time a spark plug fires. Ignition EMI is always a nuisance and in extreme cases can produce performance and safety-related malfunctions.

Levels of EMI emitted by a spark ignited engine can be controlled or suppressed by various methods. Commonly, EMI suppression of the ignition system itself is accomplished by the use of resistive spark plugs, resistive ignition leads, and inductive components in the secondary high voltage ignition circuit. A common type of resistor/suppressor spark plug used for the suppression of EMI contains an internal resistor element placed within the ceramic insulator between the upper terminal stud and the lower center electrode. While internal resistor/suppressor spark plug designs are well-known, practical considerations have frustrated the ability to integrate a resistor in small-sized spark plugs, for example those used in small engines and the like. The current trend toward compact engines in automotive applications further compounds this issue by calling for ever-smaller spark plugs with ever-increasing performance characteristics. In particular, the fairly large cross-sectional area required for the resistor inside of the insulator weakens the structural integrity of the ceramic material by creating a thin wall section precisely in the region of an insulator which is often highly stressed during assembly and installation. This diminished structural integrity is also a consideration when a loose, granular resistor material is cold-pressed into the insulator, and later hot pressed to produce the so-called "fired-in suppressor seal" pack. I.e., the thin wall sections are prone to bursting, especially during the cold-pressing operation.

Yet another consideration when attempting to down-size this type spark plug arises from the diminished dielectric capacity of the insulator in thin sections. Specifically, the ceramic insulator material is a dielectric. Dielectric strength is generally defined as the maximum electric field which can be applied to the material without causing breakdown or electrical puncture thereof. Thin cross-sections of ceramic insulator can therefore result in dielectric puncture between the charged center electrode and the grounded shell.

The prior art has recognized this problem and proposed a solution as reflected in U.S. Pat. No. 6,380,664 to Pollner, issued Apr. 30, 2002. A representation of this prior art construction is depicted in FIG. 4 of the subject application. In particular, Pollner forms the resistor portion of its spark plug with a taper to reduce its cross-sectional area toward the center electrode. While such a construction has some merit, it remains limited in applicability. For example, Pollner requires a two-piece center electrode assembly, namely a pre-trimmed, lower portion made of noble metal held in end-to-end abutting contact with an upper contact pin. The end-to-end configuration is particularly sensitive to vibration disturbances at the point of abutting contact. Also, the fragile design of Pollner's contact pin is susceptible to warpage during a hot-pressing assembly operation. Furthermore, the distance at which the end of the center electrode projects from the core nose of the insulator is established by the seat position of the center electrode within the seal. In the example of Pollner, the projection distance is controlled by seating the lower center electrode upon a step in the core nose, but not within the seal portion of the resistor pack. This can, therefore, lead to integrity issues with the seal and the seating of the center electrode. It also increases the geometrical complexity of the central passage extending longitudinally through the ceramic insulator. Manufacturing complexity is also increased in this design. And still further, Pollner teaches the desirability of sealing along a portion of the length of the contact pin, between the noble metal center electrode in the nose portion of the insulator and the larger diameter head of the metallic contact pin. We learn from Pollner's citation of the progenitor prior art that this sealing along a portion of the length of the contact pin is accomplished by special coating with boronization, aluminization, nitration, or siliconization to achieve a gas-tight bond. A similar in situ sintering of the precious metal center electrode within the insulator is also contemplated. As will be readily appreciated, this special coating process applied to the contact pin and/or the center electrode is labor-intensive and cost-additive. It is required in Pollner to achieve adequate gas-pressure sealing due to the problematic architecture of its spark plug.

Accordingly, there is a need for an improved method of integrating a resistor and seal pack inside the insulator portion of a spark plug, i.e., between the upper terminal stud and the lower center electrode, in which the structural integrity and dielectric strength of the ceramic insulator can be maintained in all applications, and in particular in applications requiring miniaturization of a spark plug geometry for small engines and the like.

SUMMARY OF THE INVENTION

The subject invention overcomes the disadvantages and shortcomings of the prior art by providing a spark plug for a spark-ignited internal combustion engine. The subject spark plug comprises an elongated ceramic insulator having an upper terminal end, a lower nose end, and a central passage extending longitudinally between the terminal and nose ends. The insulator includes an exterior surface presenting a generally circular large shoulder proximate the terminal end and a generally circular small shoulder proximate the nose end. The large shoulder has a diameter greater than the diameter of the small shoulder. A filleted transition is established between the disparate diameters of the large and small shoulders, as a feature on the exterior surface of the insulator. A conductive shell surrounds at least a portion of the insulator. The shell includes at least one ground electrode. A conductive terminal stud is partially disposed in the central passage and extends longitudinally from a top post to a bottom end embedded within the central passage. A conductive center electrode is partially disposed in the central passage and extends longitudinally between a head encased within the central passage and an exposed sparking tip proximate the ground electrode. The head of the center electrode is longitudinally spaced from the bottom end of the terminal stud within the central passage. A suppressor seal pack is disposed in the central passage and electrically connects the bottom end of the terminal stud with the head of the center electrode for conducting electricity therebetween while sealing the central passage and suppressing radio frequency noise emissions from the spark plug. The suppressor seal pack has a first cross-sectional area at the bottom end of the terminal stud and a second cross-sectional area at the head of the center electrode. The first cross-sectional area is greater than the second cross-sectional area. Furthermore, the suppressor seal pack includes a reducing taper for progressively transitioning from the greater first cross-sectional area to the lesser second cross-sectional area. The reducing taper is longitudinally disposed in a region of the central passage which is bounded at its upper most limits by the bottom end of the terminal stud and at its lower most limits by the filleted transition.

By locating the reducing taper in a region between the bottom end of the terminal stud and the filleted transition, the subject invention assures structural integrity of the ceramic insulator and also maximum dielectric strength. This is accomplished by restricting the larger first cross-sectional area of the suppressor seal pack to a region of the insulator which has the greatest cross-sectional thickness. Since the filleted transition of an insulator delineates the place at which the wall thickness of the insulator severely constricts, the subject invention takes advantage by confining the larger first cross-sectional area of the suppressor seal pack above the filleted transition. In addition, the applicant has found that by locating the taper in the resistive portion of the suppressor seal pack, enhanced EMI suppression can be achieved. In effect, the reduction in cross-sectional area accomplished by the taper increases the effective resistance of the pack without requiring a change in material properties. Accordingly, the shortcomings and disadvantages found in comparable prior art spark plugs are overcome.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Figure 1:
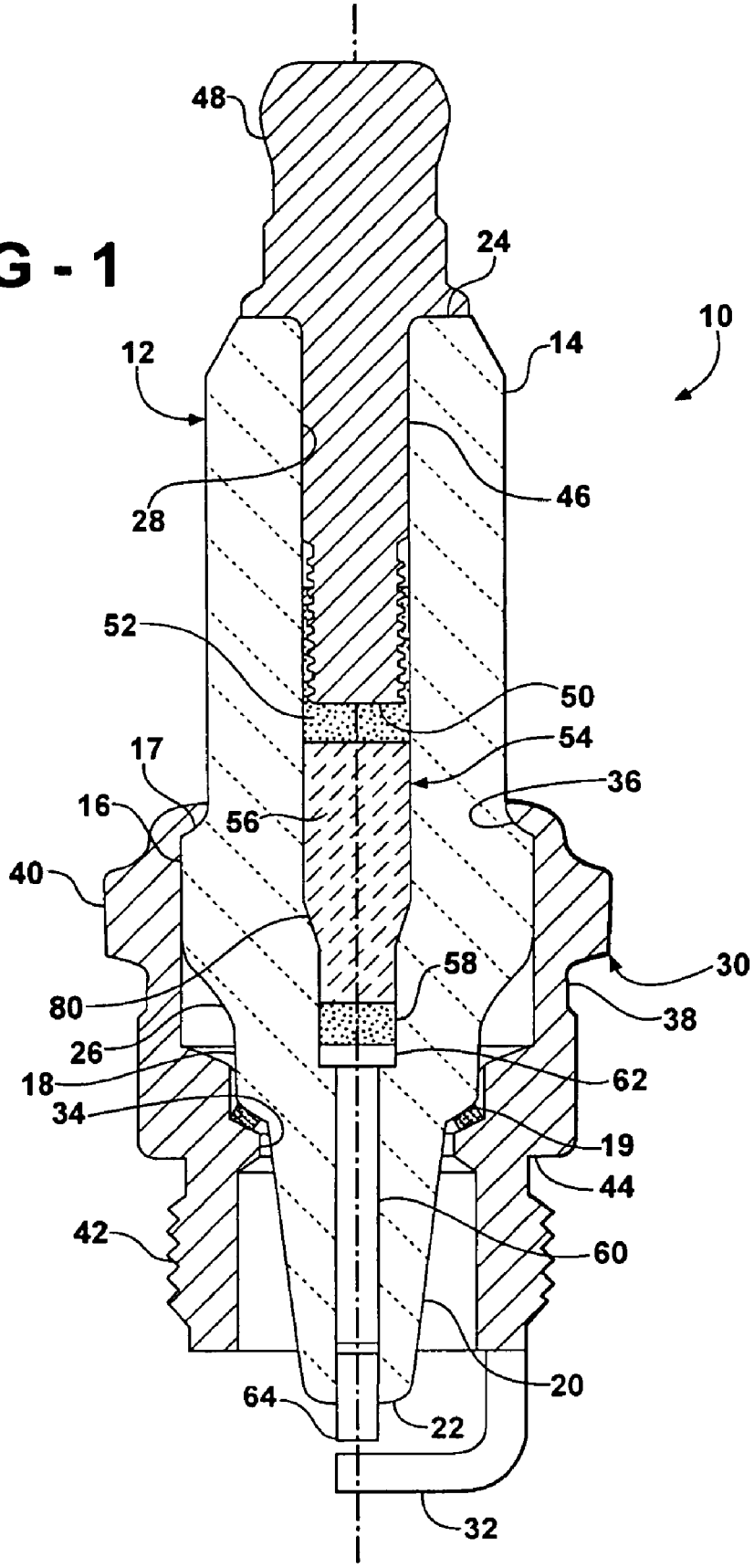
FIG. 1 is a cross-sectional view of a spark plug assembly incorporating a suppressor seal pack between the upper terminal stud and the lower center electrode having a reducing taper located in a region above the filleted transition, according to the subject invention.

Referring to the Figures, wherein like numerals indicate like or corresponding parts throughout the several views, a spark plug according to the subject invention is generally shown at 10 in FIG. 1. The spark plug 10 includes a tubular ceramic insulator, generally indicated at 12, which is preferably made from an aluminum oxide ceramic or other suitable material having a specified dielectric strength, high mechanical strength, and excellent resistance to heat shock. The insulator 12 may be molded dry under extreme pressure, and then kiln-fired to vitrification at high temperature. However, those skilled in this art will appreciate that methods other than dry press and sintering may be used to form the insulator 12. The insulator 12 has an outer surface which is preferably glazed about its exposed portions with a lead-free material, such as that disclosed in U.S. Pat. No. 5,677,250 to Knapp, issued Oct. 14, 1997 and assigned to the assignee of the subject invention. The insulator 12 may include a partially exposed upper mast portion 14 to which a rubber spark boot (not shown) surrounds and grips to establish a connection with the ignition system. The exposed portion 14 is shown in FIG. 1 as a generally smooth surface, but may include the more traditional ribs for the purpose of providing added protection against spark or secondary voltage "flash-over", and to better improve grip with the rubber spark plug boot. Immediately below the mast portion 14, is a large shoulder 16 from which the cross-sectional diameter of the insulator 12 expands to its maximum width. The large shoulder 16 develops below a generally annular upper seat 17. Further down the insulator 12, a small shoulder 18 reduces the insulator outer diameter to a tapering nose section 20. The small shoulder 18 terminates in a generally annular lower seat 19. A nose end 22 establishes the bottom most portion of the insulator 12, whereas a terminal end 24 establishes the extreme opposite, uppermost end of the insulator 12, formed at the top of the mast portion 14. A filleted transition 26 is an exterior surface feature of the insulator 12, formed between the large shoulder 16 and the small shoulder 18. The filleted transition 26 provides a smooth change from the greater insulator diameter at the large shoulder 16 to the lesser diameter at the small shoulder 18.

The insulator 12 is of generally tubular construction, including a central passage 28 extending longitudinally between the upper terminal end 24 and the lower nose end 22. The central passage 28 is of varying cross-sectional area, generally greatest at or adjacent the terminal end 24 and smallest at or adjacent the nose end 22.

A conductive, preferably metallic, shell is generally indicated at 30. The shell 30 surrounds the lower regions of the insulator 12 and includes at least one ground electrode 32. While the ground electrode 32 is depicted in the traditional single J-shaped style, it will be appreciated that multiple ground electrodes, or an annular ground electrode, or any other known configuration can be substituted depending upon the intended application for the spark plug 10.

The shell 30 is generally tubular in its body section, and includes an internal lower compression flange 34 adapted to bear in pressing contact against the lower seat 19 of the insulator 12. The shell 30 further includes an upper compression flange 36 which is crimped or deformed over during the assembly operation to bear in pressing contact against the upper seat 17 of the insulator 12. A buckle zone 38 collapses under the influence of an overwhelming compressive force during or subsequent to the deformation of the upper compression flange 36, to hold the shell 30 in a fixed position with respect to the insulator 12. Gaskets, cement or other sealing compounds can be interposed between the insulator 12 and shell 30 at the points of engagement to perfect a gas tight seal and improve the structural integrity of the assembled spark plug 10. Accordingly, after assembly, the shell 30 is held in tension between the upper 36 and lower 34 compression flanges, whereas the insulator 12 is held in compression between the upper seat 17 and the lower seat 19. This results in a secure, gas-tight, permanent fixation between the insulator 12 and the shell 30. Although the type of seal described and depicted in FIG. 1 is of the so-called "hot lock" type, those of skill will understand that the alternative sillment type seal could be used in certain applications with effectiveness.

The shell 30 further includes a tool receiving hexagon 40 for removal and installation purposes. The hex size complies with industry standards for the related application. A threaded section 42 is formed at the lower portion of the metallic shell 30, immediately below a seat 44. The seat 44 may either be tapered to provide a close tolerance installation in a cylinder head which is designated for this style of spark plug, or may be provided with a gasket (not shown) to provide a suitable interface against which the spark plug seats in the cylinder head.

A conductive terminal stud 46 is partially disposed in the central passage 28 of the insulator 12 and extends longitudinally from an exposed top post 48 to a bottom end 50 embedded part way down the central passage 28. The top post 48 connects to an ignition wire (not shown) and receives timed discharges of high voltage electricity required to fire the spark plug 10.

The bottom end 50 of the terminal stud 46 is embedded within a conductive glass seal 52 forming the top layer of a composite suppressor-seal pack or assembly, generally indicated at 54. To ensure adequate clearance for glass flow during hot pressing, a radial clearance of about 0.005" is provided around the insulator wall. The conductive glass seal 52 functions to seal the bottom end 50 of the terminal stud 46 within the central passage 28, while conducting electricity from the terminal stud 46 to a resistor layer 56. This resistor layer 56, which comprises the center layer of the 3-tier suppressor seal pack 54, can be made from any suitable composition known to reduce electromagnetic interference (EMI). The suppressor glass seal includes glass, fillers, and carbon/carbonaceous materials in such ratios to ensure appropriate resistance when pressed and provide a stable resistance over the anticipated service life. Depending upon the recommended installation and the type of ignition system used, such resistor layers 56 may be designed to function as a more traditional resistor suppressor, or in the alternative as an inductive suppressor. Immediately below the resistor layer 56, another conductive glass seal 58 establishes the bottom, or lower layer of the suppressor seal pack 54. The conductive glass can be made from a mixture of glass and copper metal powder at approximately 1:1 ratio by mass, as is well-known in the industry. Accordingly, electricity travels from the bottom end 50 of the terminal stud 46, through the top layer conductive glass seal 52, through the resistor layer 56 and into the lower conductive glass seal layer 58.

A conductive center electrode 60 is partially disposed in the central passage 28 and extends longitudinally between a head 62 encased in the lower glass seal layer 58 to an exposed sparking tip 64 proximate the ground electrode 32. Thus, the head 62 of the center electrode 60 is longitudinally spaced from the bottom end 50 of the terminal stud 46, within the central passage 28. The suppressor seal pack 54 electrically interconnects the terminal stud 46 and the center electrode 60, while simultaneously sealing the central passage 28 from combustion gas leakage and also suppressing radio frequency noise emissions from the spark plug 10. As shown, the center electrode 60 is preferably a one-piece, unitary structure extending continuously and uninterrupted between its head 62 embedded in the glass seal 58 and its sparking tip 64 opposite the center electrode. The sparking tip 64 may or may not be fitted with a precious or noble metal end which is known to enhance service life. One advantage of this invention is that the center electrode 60 does not need to be made entirely of a homogenous precious metal as is required in comparable prior art designs.

Figures 2A, 2B, 2C, 2D:
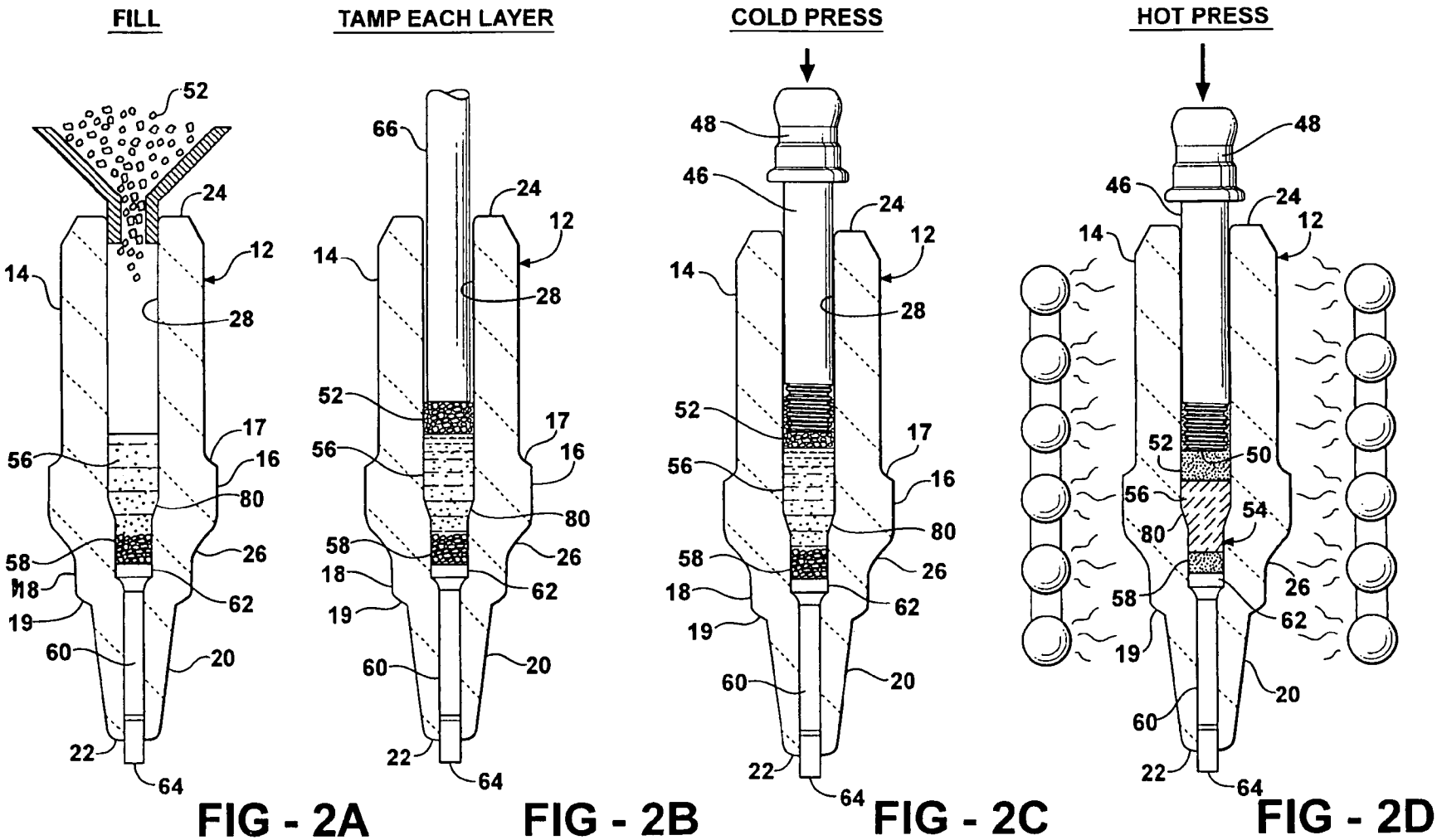
FIGS. 2A-D depict, in simplified form, a sequential method for forming a fired-in suppressor seal pack between the lower center electrode and the upper terminal stud by filling the central passage with suitable granular materials for the layered suppressor seal pack, then tamping each layer, cold pressing the terminal stud into position, and finally hot pressing the layered pack using the terminal stud.

Referring now to FIGS. 2A-D, a preferred method for installing the suppressor seal pack 54 within the central passage 28 is illustrated schematically. According to the preferred embodiment of this invention, the suppressor seal pack 54 is of the fired-in type, wherein each of the layers 52, 56, 58 are separately laid down in a filling operation as shown in FIG. 2A. Specifically, a sintered insulator 12 is loaded with the center electrode 60 as shown in FIG. 2A. Next, a measured quantity of granular material comprising the lower conductive glass seal layer 58 is poured into the central passage 28, directly upon the head 62 of the center electrode 60. This loose-filled lower glass seal layer 58 is then tamped with a plunger 66 to a compacted pressure greater than 20 kpsi, preferably. The tamped glass seal layer 58 is followed by a measured quantity of granular materials comprising the resistor layer 56, which is also tamped to compaction in order to achieve a uniform density; it may be desirable to deliver the resistor layer 56 in two shots, tamping after each fill. Finally, a measured quantity of granular conductive glass seal material is loaded on top of the resistor layer 56, and comprises the top layer conductive glass seal 52. The top layer 52 is tamped to the specified density, as shown in FIG. 2B.

Once these granular materials have been loaded into the central passage 28, the terminal stud 46 is forced down the central passage 28, cold-compressing the granular materials as shown in FIG. 2C. The semi-finished assembly is then transferred to a hot press operation as depicted in FIG. 2D. Here, the insulator 12, together with the cold-pressed suppressor seal pack 54, is heated to a temperature at which the granular materials 52, 56, 58 soften and fuse. The heated assembly is withdrawn from the furnace, and the terminal stud 46 is forced toward a fully seated position where its top post 48 closes the opening to the central passage 28. In this operation, the softened material of the lower conductive glass seal layer 58 flows around the head 62 of the center electrode 60, and seals the central passage 28 in the region of the head 62. Likewise, the bottom end 50 of the terminal stud 46 becomes fully embedded within the top layer of the conductive glass seal 52, thereby fixing it in position while simultaneously sealing the central passage 28 from combustion gas leakage. By this method, the suppressor seal pack 54 can be formed of the fired-in type which is robust, economical, and effective in terms of suppressing radio frequency noise emissions and sealing the central passage 28 from combustion gas leakage.

Figure 3:
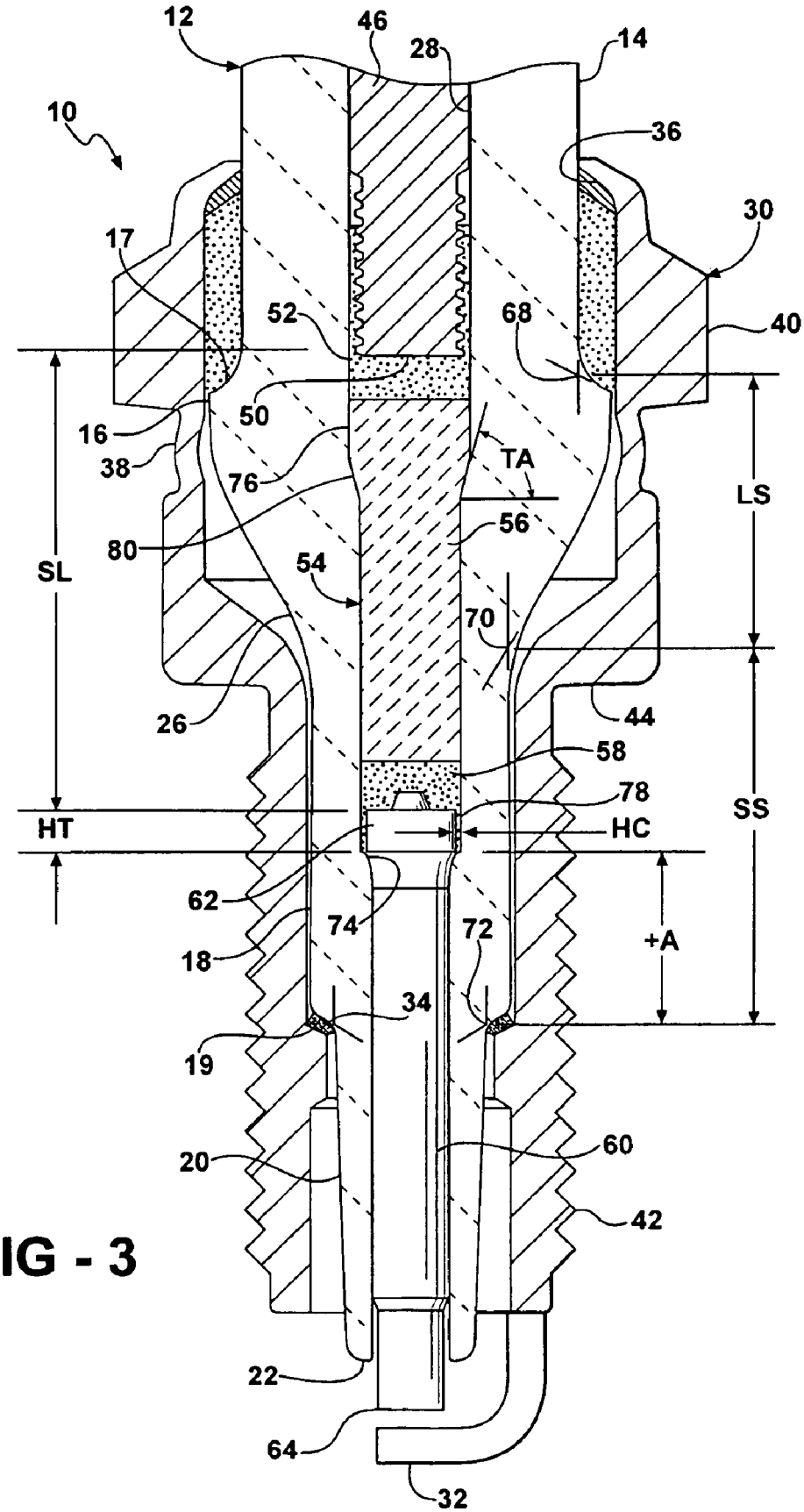
FIG. 3 is a cross-sectional view of the lower portion of a spark plug according to the subject invention depicting various dimensional relationships of significance.

Referring now to FIG. 3, an enlarged view of the lower portion of the spark plug 10 is shown including various dimensional and geometric relationships pertinent to the subject invention. These dimensional relationships include the effective suppressor seal pack length SL which may be defined as the longitudinal distance between the bottom end 50 of the terminal stud 46 and the head 62 of the center electrode 60. In an exemplary embodiment, the seal length SL may be about 0.50 inches, however other lengths may be used. A head thickness HT may be defined as the longitudinal measure of that cylindrical outer wall portion of the center electrode head 62. Preferably, the head thickness HT is minimized to allow a greater length, and hence more effectiveness, for the suppressor seal pack 54. The head thickness HT of the preferred embodiment may typically be in a range between 0.040-0.070 inches. If the head thickness HT is too thin, e.g., 0.025", it may lead to poor sealing and undesirable resistance changes over time.

A head clearance HC may be defined as the radial clearance space between the outer cylindrical wall of the head 62 and the surrounding portion of the central passage 28. Typically, the head clearance HC will be sized to promote good flow and fill of the lower glass seal layer 58 during the hot press operation as shown in FIG. 2C. In the preferred embodiment, the head clearance HC is at least 0.005 inches.

Other significant dimensions may be keyed to external features of the insulator 12. For example, the large shoulder 16 may be located in the longitudinal direction by the theoretical intersection 68 between the mast portion 14 and the angled surface of the upper seat 17 forming an upper limit and the filleted transition 26 forming its lower limit. Specifically, the filleted transition 26 is defined at the theoretical intersection 70 of that outer surface tapering inwardly from the large shoulder 16 and that generally straight, shank-like portion of the outer surface forming the small shoulder 18. The small shoulder 18 is thus located between the filleted transition reference point 70 and the theoretical intersection 72 between the tapered portion of the lower seat 19 and the nose section 20. Hence, a large shoulder section LS (which represents the length of the large shoulder 16) is defined as the longitudinal region between reference points 68 and 70, whereas a small shoulder section SS (which represents the length of the small shoulder 18) is the longitudinal region between reference points 70 and 72.

The center electrode head 62 is seated at its bottom edge on an internal ledge 74 in the central passage 28. The internal ledge 74 establishes a transition to a smaller cross-sectional diameter which is generally equivalent to the straight, cylindrical length of the center electrode 60 plus a moderate clearance. This internal ledge 74 also coincides with the lowermost reaches, or base, of the suppressor seal pack 54. The internal ledge 74 can be shaped with a convex or radiused profile to engage a correspondingly shaped undersurface of the head 62 and thereby perfect a tight sealing seat without introducing excessive stresses into the material of the insulator 12 during the cold press operation (FIG. 2C).

Figure 4:
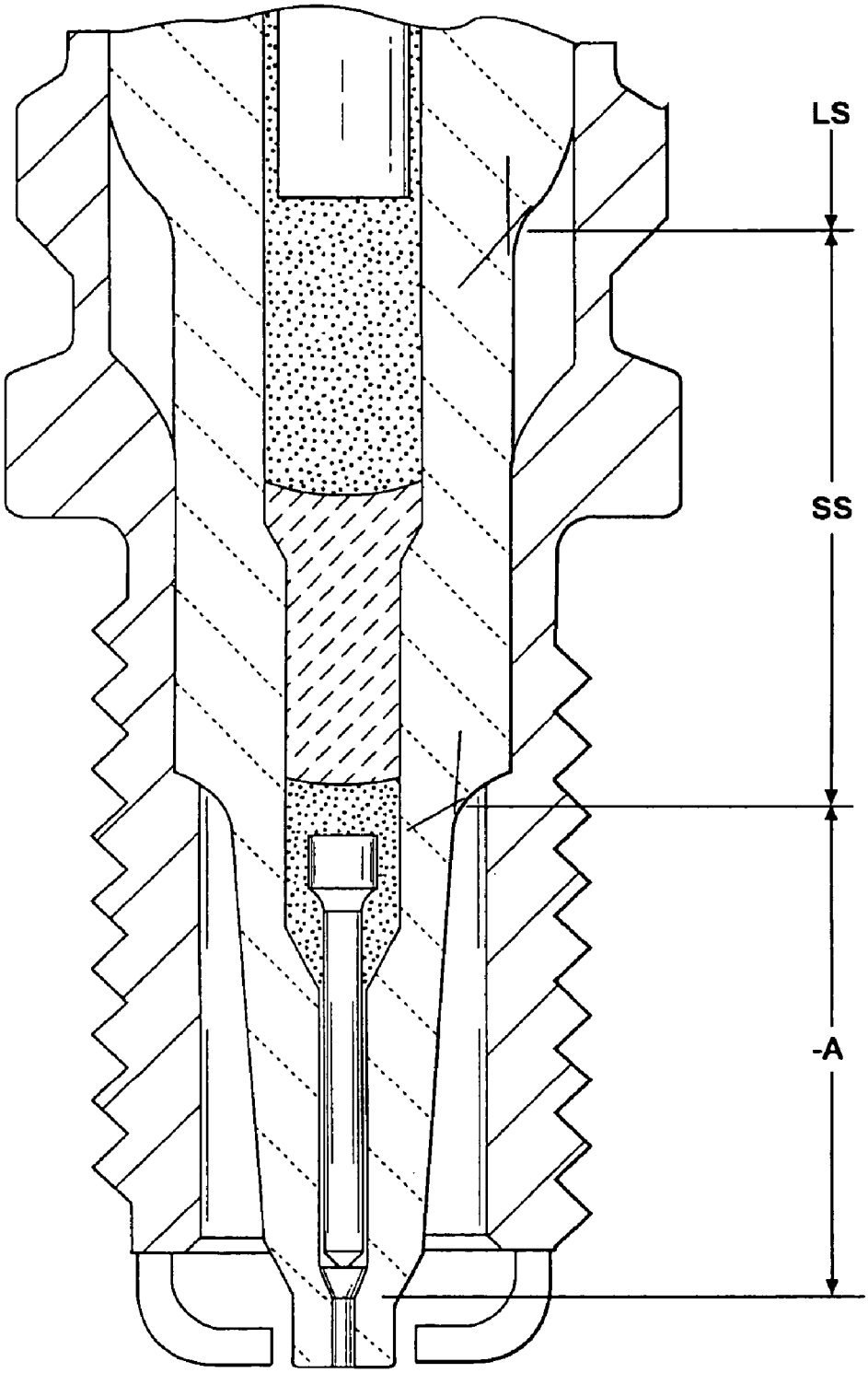
FIG - 4 PRIOR ART
FIG. 4 is a cross-sectional view of the lower portion of a spark plug according to the prior art, and identifying various dimensional relationships for comparison purposes with FIG. 3.

An "A" dimension is defined as the longitudinal measure between the small shoulder reference point 72 and the internal ledge 74 where the bottom of the center electrode head 62 seats. A positive "A" dimension (+A) occurs when the center electrode head 62 is disposed longitudinally between the small shoulder reference point 72 and the filleted transition reference point 70. A negative "A" dimension (−A) results when the internal ledge 74 is located between the small shoulder reference point 72 and the nose end 22 of the insulator 12. As shown in FIGS. 1 and 3, the subject spark plug 10 is designed to include a positive "A" dimension (+A). This is in contrast to the prior art designs as exemplified in FIG. 4, wherein the "A" dimension is negative (−A). As a result, the prior art insulators are substantially weaker and more likely to fracture during the cold press operation due to the reduced wall thickness between its central passage and its nose section.

The subject suppressor seal pack 54 is of the tapered variety, which, as best shown in FIG. 3, includes a first cross-sectional area 76 at the bottom end 50 of the terminal stud 46, and a second cross-sectional area 78 adjacent the head 62 of the center electrode 60. The diameter of the first cross-sectional area 76 is slightly larger than the diameter of the terminal stud 46. Likewise, the diameter of the second cross-sectional area 78 is slightly larger than the diameter of the center electrode head 62. As shown, the first cross-sectional area 76 is greater than the second cross-sectional area 78, thereby permitting a reduction in the diameter of the suppressor seal pack 54, and a corresponding reduction in the diameter of the central passage 28 as the thickness of the insulator 12 reduces from the large shoulder section LS to the small shoulder section SS. A reducing taper 80 is provided for progressively transitioning from the greater first cross-sectional area 76 to the lesser second cross-sectional area 78. The reducing taper 80 is longitudinally positioned so that it resides in a region of the insulator 12 best suited to absorbing the additional stresses visited upon such a configuration during the cold pressing operation. The exact location of the reducing taper 80 can be adjusted to suit a particular application requirement, but is preferably confined to a region bounded at its upper most limit or range by the bottom end 50 of the terminal stud and at its lower most limit or range by the location 70 of the filleted transition 26. Thus, the reducing taper 80 is wholly located within the large shoulder section LS. By this strategy, the greater first cross-sectional area 76 is precluded from migrating into the smaller diameter region of the insulator 12 associated with the small shoulder section SS. As a result, the wall thickness of the insulator 12 is maintained so as to uphold structural integrity and maximize the dielectric properties of the insulator 12 in its most vulnerable regions, i.e., in the area of the head thickness HT.

The reducing taper 80 may take various geometric configurations, but is shown in the preferred embodiment having a straight, conical sidewall. Mindful of the expansionary forces imposed upon the central passage 28 during the cold pressing operation (FIG. 2C), the reducing taper 80 is provided with a fairly steep taper angle TA, which is defined as the angular measure between the conical sidewall and a perpendicular reference line, a shown in FIG. 3. The steep taper angle is intentionally set at greater than or equal to 60° to provide good powder flow during the filling operation (FIG. 2A) and to facilitate compaction during both the cold and hot pressing operations (FIGS. 2C and 2D). The steep taper angle promotes "mass flow" during the filling operations, thereby improving fill and compaction. This also simplifies manufacturing by allowing apparatus designed for larger bores to deliver powder accurately. A disadvantage of prior art small bores is seen in that the powder feeding apparatus and related equipment must be modified to ensure all of the powder is delivered to the bore. The design of the subject invention obviates these complications. The steep taper angle also helps to pilot the plunger 66 and terminal stud 46 during cold pressing.

In addition to maximizing the insulator 12 strength and dielectric properties, the tapered suppressor seal pack 54 also enhances the gas-tight qualities of the seal established around the center electrode head 62. More specifically, during the hot press operation as depicted in FIG. 2D, the force exerted on the molten layers 52, 56, 58 is concentrated within the reduced area of the head clearance HC. This results in a high-pressure forcing of the molten lower glass seal layer 58 in the interstitial space of the head clearance HC and tight against the internal ledge 74, where the underside of the head 62 seats. As a result, the central passage 28 is permanently sealed against combustion gas leakage when in operation.

Another advantage of the subject tapered suppressor seal pack 54 arises out of its enabling use of larger diameter, and hence more robust, terminal studs 46. In many applications, including small engine applications, there is a tendency toward the use of so-called "coil-on-plug" designs, wherein a heavy ignition coil is supported directly on top of the spark plug 10. These heavy designs impose significantly greater torsional stresses on the terminal stud 46, which stresses can be better withstood through the use of larger diameter materials. Small engine applications, such as used in lawn and garden power tools, are notorious for producing high-frequency vibrations which can be better resisted through the more robust terminal stud 46. The subject tapered suppressor seal pack 54 enables the use of such larger diameter terminal studs 46 without compromising the structural integrity and dielectric properties of the insulator 12 in its more vulnerable, small shoulder section SS and nose section 20. The larger diameter terminal stud 46 also is less prone to buckling during hot pressing operations. Prior art style small diameter terminal studs, by contrast, tend to soften and buckle during hot pressing, thus reducing load transfer to the glass pack and stressing the insulator.

Obviously, many modifications and variations of the present invention are possible in light of the above teachings. It is, therefore, to be understood that within the scope of the appended claims, the invention may be practiced otherwise than as specifically described.

What is claimed is:

1. A spark plug for a spark-ignited internal combustion engine, said spark plug comprising:

an elongated ceramic insulator having an upper terminal end, a lower nose end, and a central passage extending longitudinally between said terminal and nose ends;

said insulator including an exterior surface presenting a generally circular large shoulder proximate said terminal end and a generally circular small shoulder proximate said nose end, said large shoulder having a diameter greater than the diameter of said small shoulder, and further including a filleted transition between the disparate diameters of said large and small shoulders;

a conductive shell surrounding at least a portion of said insulator, said shell including at least one ground electrode;

a conductive terminal stud partially disposed in said central passage and extending longitudinally from an exposed top post to a bottom end embedded within said central passage;

a conductive center electrode partially disposed in said central passage and extending longitudinally between a head encased within said central passage and an exposed sparking tip proximate said ground electrode, said head being longitudinally spaced from said bottom end of said terminal stud within said central passage;

a suppressor seal pack disposed in said central passage and electrically connecting said bottom end of said terminal stud with said head of said center electrode for conducting electricity therebetween while sealing said central passage and suppressing radio frequency noise emissions from said spark plug, said suppressor seal pack having a first cross-sectional area at said bottom end of said terminal stud and a second cross-sectional area at said head of said center electrode, said first cross-sectional area being greater than said second cross-sectional area; and said suppressor seal pack including a reducing taper for progressively transitioning from said greater first cross-sectional area to said lesser second cross-sectional area, said reducing taper being longitudinally located in a region bounded at its uppermost limit by said bottom end of said terminal stud and at its lowermost limit by said filleted transition.

2. The spark plug of claim 1 wherein said shell includes upper and lower compression flanges bearing in pressing contact with said respective large and small shoulders of said insulator to place said insulator in compression between said large and small shoulders.

3. The spark plug of claim 1 wherein said reducing taper has a generally conical sidewall angled relative to a perpendicular reference line greater than or equal to 60°.

4. The spark plug of claim 3 wherein said reducing taper is longitudinally disposed between said large shoulder and said filleted transition.

5. The spark plug of claim 1 wherein said suppressor seal includes upper and lower conductive glass ends in contact with said bottom end of said terminal and said head of said center electrode respectively.

6. The spark plug of claim 1 wherein said suppressor seal has a base disposed longitudinally between said filleted transition and said small shoulder.

7. The spark plug of claim 1 wherein said central passage includes an internal ledge for seating said head of said center electrode.

8. The spark plug of claim 7 wherein said ledge is disposed longitudinally between said small shoulder and said filleted transition.

9. The spark plug of claim wherein said head of said center electrode has a generally cylindrical outer wall defining a longitudinal head thickness in the range of 0.040" to 0.070".

10. The spark plug of claim 1 wherein said center electrode comprises a one-piece unitary structure extending between said head and said sparking tip thereof.

* * * * *